US006296478B1

(12) United States Patent
Gatley, Jr.

(10) Patent No.: US 6,296,478 B1
(45) Date of Patent: Oct. 2, 2001

(54) METHOD AND APPARATUS FOR COOLING A FURNACE MOTOR

(75) Inventor: William Stuart Gatley, Jr., Cassville, MO (US)

(73) Assignee: Jakel Incorporated, Highland, IL (US)

( * ) Notice: Subject to any disclaimer, the term of this patent is extended or adjusted under 35 U.S.C. 154(b) by 0 days.

(21) Appl. No.: 09/631,925

(22) Filed: Aug. 3, 2000

(51) Int. Cl.[7] ..... F27D 1/12

(52) U.S. Cl. ..... 432/77; 432/173; 432/233; 126/104 A

(58) Field of Search ..... 432/77, 116, 145, 432/173, 233; 126/110 A, 110 C, 110 E, 104 A, 116 C; 310/52

(56) References Cited

U.S. PATENT DOCUMENTS

| | | | | |
|---|---|---|---|---|
| 2,654,529 | | 10/1953 | Smith . | |
| 3,730,642 | | 5/1973 | Barnstead et al. . | |
| 4,626,720 | * | 12/1986 | Fukasaku et al. | 310/62 |
| 4,906,182 | * | 3/1990 | Moller | 432/77 |
| 5,201,024 | * | 4/1993 | Steffes | 126/400 |
| 5,834,869 | * | 11/1998 | Morgan et al. | 310/89 |
| 6,021,775 | * | 2/2000 | Dempsey et al. | 126/116 R |
| 6,216,685 | | 4/2001 | Payne . | |
| 6,231,311 | | 5/2001 | Gatley et al. . | |

* cited by examiner

*Primary Examiner*—Gregory Wilson
(74) *Attorney, Agent, or Firm*—Howell & Haferkamp, LC

(57) ABSTRACT

A furnace includes a motor in a motor housing that drives a fan that draws heated air through a heat exchanger of the furnace and also draws a flow of air through the motor housing to cool the motor as well as the motor housing.

23 Claims, 5 Drawing Sheets

METHOD AND APPARATUS FOR COOLING A FURNACE MOTOR

BACKGROUND OF THE INVENTION (i) Field of the Invention

This invention relates generally to furnaces and particularly to cooling a motor that drives a draft inducing fan in a furnace. The invention provides for an improved method of cooling the motor that drives the fan and an apparatus for practicing the method.

(ii) Description of the Related Art

Typically, fans driven by an electric motor are used to induce an air flow in a furnace. These fans are designed to produce a certain amount of air flow which is used to remove the products of combustion in a gas-fired furnace and provide a flow of heated air through a heat exchanger. The air flow induced by these fans does not come in contact with the motor and therefore, does not contribute to the cooling of the motor nor dissipation of the heat generated by the motor.

in typical prior art furnaces, the fan motor is located in the vestibule of the furnace which also houses the electronics and controls for controlling the furnace. The heat generated by the blower motor elevates the temperature within the vestibule. The elevated temperature within the vestibule can shorten the life of the electronics and controls located within the vestibule. Additionally, the excess heat generated by the motor can shorten the life of the motor itself.

Typical prior art furnace fans utilize a motor that has an auxiliary fan attached to the rotating shaft of the motor to cool the motor. The auxiliary fan forces a flow of air to flow across the motor to dissipate the heat generated by the motor. An auxiliary fan, however, has many disadvantages.

One disadvantage is that the auxiliary fan increases the size or height of the motor assembly thereby preventing the streamlining of the motor assembly and the associated furnace within which the motor assembly is used. Another disadvantage is that the use of an auxiliary fan produces an additional load on the motor which can reduce the overall motor efficiency and increase the energy consumption of the furnace in which is it used. Furthermore, the use of an auxiliary fan increases the cost of providing the draft inducing fan. Another disadvantage is that the auxiliary fan can generate additional noise which may require the furnace within which it is used to incorporate additional sound deadening techniques. Finally, because the motor is typically used in a vestibule, the air flow induced by the auxiliary fan is channeled into the vestibule thereby contributing to the elevated temperature of the vestibule and the associated components residing therein.

Therefore, it is an object of the present invention to provide an apparatus and method for cooling the motor that eliminates the need for an auxiliary fan.

SUMMARY OF THE INVENTION

The present invention overcomes shortcomings of prior art furnaces that use an auxiliary fan attached to the motor to cool the motor driving the draft inducing fan by providing a furnace that cools the motor with the flow of air induced by the draft inducing fan. By eliminating the need for an auxiliary fan, the present invention allows for the motor and fan assembly to be more compact and streamlined than the prior art motor, fan and auxiliary fan assemblies. Additionally, the present invention reduces the overall cost of providing a means to cool the motor while reducing the noise associated with cooling the motor with only a minimal load being placed on the motor.

In general, the furnace of the present invention is comprised of a motor which resides in a housing having at least one inlet and at least one outlet. A fan is driven by the motor and resides in a fan housing. The fan housing is operatively connected to and communicates with the motor housing and is configured and adapted to cause a flow of air to flow through the motor housing prior to entering the fan housing, thereby cooling the motor.

More specifically, the furnace is comprised of a motor in a motor housing having at least one inlet and at least one outlet. A combustion chamber has at least one inlet and an outlet with the at least one combustion chamber inlet being operatively connected to and communicating with the at least one motor housing outlet. A heat exchanger has an inlet and an outlet with the heat exchanger inlet being operatively connected to and communicating with the combustion chamber outlet. A fan driven by the motor resides in a fan housing and the fan housing has an inlet and an outlet. The heat exchanger outlet is operatively connected to and communicates with the fan housing inlet. The fan causes a flow of air to flow into the motor housing through the at least one motor housing inlet, around the motor, and exit the motor housing through the at least one motor housing outlet. The flow of air then flows into the combustion chamber through the at least one combustion chamber inlet, through the combustion chamber, and exits the combustion chamber through the combustion chamber outlet. The flow of air then flows into the heat exchanger through the heat exchanger inlet, through the heat exchanger, and exits the heat exchanger through the heat exchanger outlet. The flow of air then flows into the fan housing through the fan housing inlet and exits the fan housing through the fan housing outlet. The flow of air cools the motor as it flows through the motor housing and around the motor without the need for an auxiliary fan.

BRIEF DESCRIPTION OF THE DRAWINGS

Further objectives and features of the present invention are set forth in the following detailed description of the preferred embodiment of the invention and in the drawing figures wherein.

DETAILED DESCRIPTION OF THE INVENTION

Figure 1A:
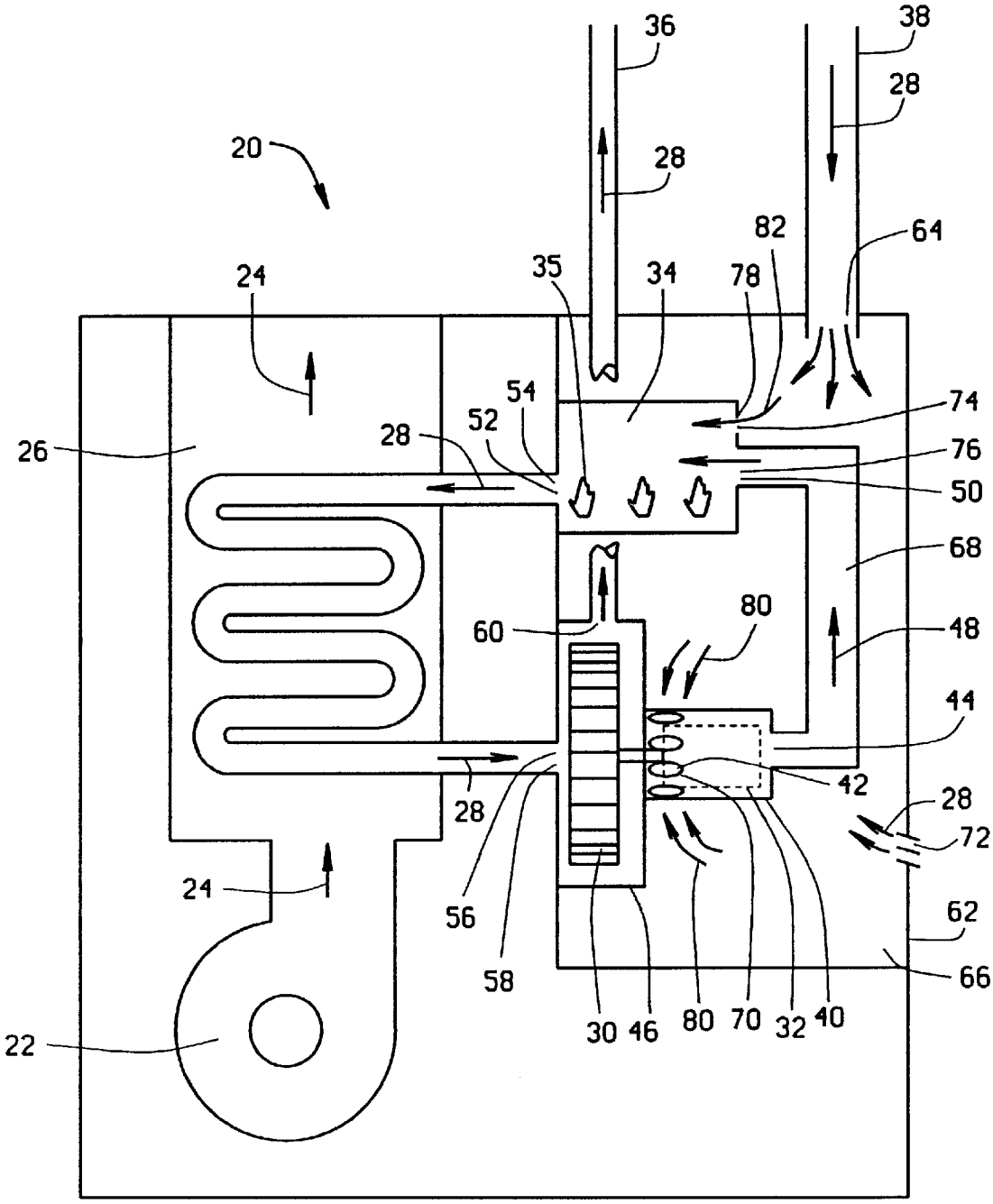
FIG. 1A is perspective view of a traditional furnace employing one embodiment of the present invention to cool the motor driving the fan.

The furnace, as can be seen in FIG. 1A and generally indicated as 20, is basically comprised of a blower 22 which draws a flow of air 24 from the exterior environment and draws the flow of air 24 through a heat exchanger 26 wherein the flow of air 24 is heated and flows out of the heat exchanger and back into the environment which is to be heated by the furnace 20. The furnace 20 heats the flow of air 24 in the heat exchanger 26 by drawing a flow of combustion heated air 28 through the heat exchanger 26. The flow of combustion heated air 28 is drawn through the heat exchanger 26 by a fan 30 which is driven by a motor 32. The flow of air 28 is heated in a combustion chamber 34 by burners 35 or the like, as is well known in the industry, prior to being drawn through the heat exchanger 26. The flow of combustion air 28 is drawn into the fan 30 and exhausted through an exhaust pipe 36. In the case of a high efficiency furnace, the air being drawn into the combustion chamber 34 originates from outside the furnace 20 and can be in the room environment or outside the environment which is to be heated and is drawn into the furnace through the inlet pipe 38. Although, it should be understood that while the exhaust and inlet pipes 36, 38 have been described as pipes they can be part of a chimney or other air channeling structures as are well known in the industry.

Preferably, the motor 32 resides in a housing 40 having at least one inlet 42 and at least one outlet 44. The fan 30 which is driven by the motor 32 resides in a fan housing 46 and is operatively connected to and communicates with the at least one motor housing outlet 44 and is configured and adapted to cause a flow of air 48 to flow through the motor housing 40 prior to flowing through the fan housing 46. The flow of air 48 thereby cools the motor 32 as it flows through the motor housing 40 and around the motor 32.

Preferably, the combustion chamber 34 has at least one inlet 50 and an outlet 52. The at least one combustion chamber inlet 50 is operatively connected to and communicates with the at least one motor housing outlet 44 so that the flow of air 48 through the motor housing 40 flows through the combustion chamber 34 prior to flowing into the fan housing 46. The heat exchanger 36 has an inlet 54 and an outlet 56. The heat exchanger inlet 54 is operatively connected to and communicates with the combustion chamber outlet 52 and the heat exchanger outlet 56 is operatively connected to and communicates with the fan housing 46. The flow of air 48 through the combustion chamber 34 flows through the heat exchanger 26 prior to flowing into the fan housing 46. The fan housing 46 has an inlet 58 and an outlet 60. The fan housing inlet 58 is operatively connected to and communicates with the heat exchanger outlet 56 and the fan housing outlet 60 is operatively connected to and communicates with the exhaust pipe 36. The fan 30 causes the flow of air 48 to enter the motor housing 40 through the at least one motor housing inlet 42, flow around the motor 32 and through the motor housing 40, and then exit the motor housing 40 through the at least one motor housing outlet 44. The flow of air 48 then flows into the combustion chamber 34 through the at least one combustion chamber inlet 50 and through the combustion chamber 34 where it mixes with the furnace fuel and is heated by combustion, and then exits the combustion chamber 34 through the combustion chamber outlet 52. The flow of combustion heated air 48 then flows into the heat exchanger 26 through the heat exchanger inlet 54 and through the heat exchanger 26, and then exits the heat exchanger 26 through the heat exchanger outlet 56. The flow of combustion heated air 48 then flows into the fan housing 46 through the fan housing inlet 58 and through the fan housing 46, and then exits the fan housing 46 through the fan housing outlet 60. The flow of air 48 then exits the furnace 20 through the exhaust pipe 36. The flow of air 48 thereby cools the motor 32 as it flows through the motor housing 40 and around the motor 42.

Preferably, the furnace 20 also has a vestibule chamber 62 which has at least one inlet 64. The motor 32 and the motor housing 46 reside in an interior 66 of the vestibule chamber 62. In a typical furnace, the vestibule chamber interior 66 also contains the electronics and controls (not shown) to control the operation of the furnace 20. The flow of air 28 being drawn into the furnace 20 by the fan 30 flows through the at least one vestibule chamber inlet 64 prior to flowing through the combustion chamber 34.

In a preferred embodiment, as can be seen in FIGS. 1A and B, the at least one motor housing outlet 44 is connected to and communicates with the at least one combustion chamber inlet 50 by an air passageway 68. The air passageway 68 channels the flow of air 48 from the at least one motor housing outlet 44 to the at least one combustion chamber inlet 50. The flow of air 48 flowing through the motor housing 40 flows through the vestibule chamber interior 66 prior to flowing into the motor housing 40. The flow of air 48 thereby cooling the electronics and controls (not shown) and any other components that reside in the vestibule chamber interior 66 along with cooling the motor 32.

In one aspect of the preferred embodiment, the at least one motor housing inlet 42 is one of a plurality of motor housing inlets 70 and the at least one vestibule chamber inlet 64 is one of a plurality of vestibule chamber inlets 72. The flow of air 28 being drawn into the furnace 20 by the fan 30 flows through the plurality of vestibule chamber inlets 72 and into the vestibule chamber interior 66. The flow of air 48 that flows through the motor housing 40 flows from the vestibule chamber interior 66 and into the motor housing 40 through the plurality of motor housing inlets 70.

Figure 1B:
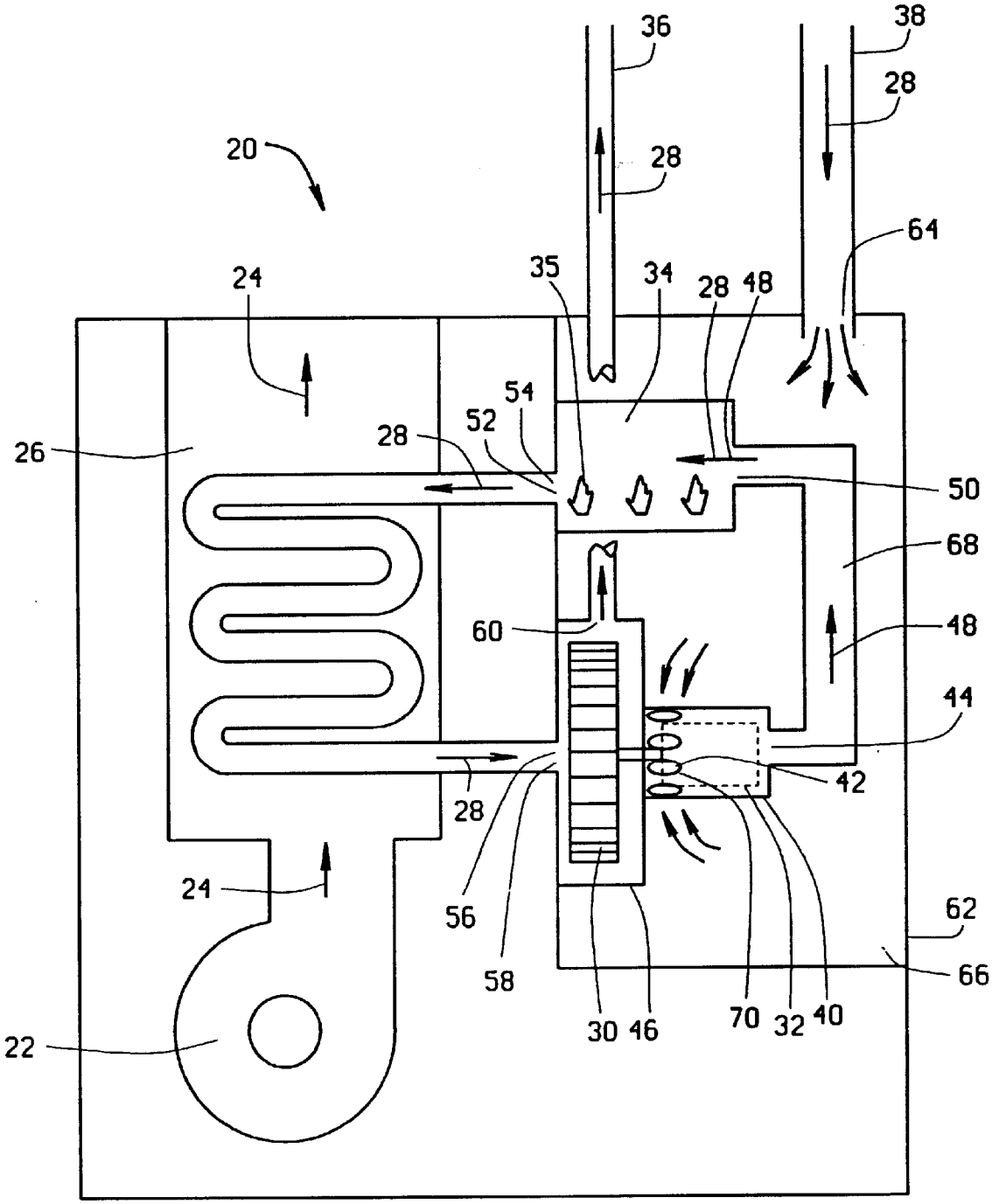
FIG. 1B is a perspective view of the furnace of figure 1A wherein the combustion chamber has a single inlet and the vestibule chamber has a plurality of inlets.

In another aspect of the preferred embodiment, the combustion chamber 34 is sealed, as shown in FIG. 1B, and all the air flowing through the combustion chamber 34 flows through the air passageway 68 prior to flowing into the combustion chamber 34. Because the combustion chamber 34 is sealed, the flow of air 28 being drawn into the furnace 20 by the fan 30 is the same flow of air 48 that is flowing through the motor housing 40. The flow of air 28 enters the vestibule chamber interior 66 through the at least one vestibule chamber inlet 64 and flows into the motor housing 40 through the at least one motor housing inlet 42. The flow of air 28 then flows through the motor housing 40 and into the air passageway 68 through the at least one motor housing outlet 44. The flow of air 28 then flows through the air passageway 68 and into the combustion chamber 34 through the at least one combustion chamber inlet 50, which is connected to the air passageway 68 and exits the combustion chamber 34 through the combustion chamber outlet 52. The flow of air 28 then flows through the heat exchanger 26 and the fan housing 46 as previously discussed. Because all of the air being drawn into the furnace 20 by the fan 30 flows through the motor housing 40, a maximum amount of air flows through the motor housing 40 and a maximum amount of cooling is achieved.

In yet another aspect of the preferred embodiment, as can been seen in FIG. 1A, the at least one combustion chamber inlet 50 is one of a plurality of combustion chamber inlets. The plurality of combustion chamber inlets include a main combustion chamber inlet 76 and secondary combustion chamber inlet 78. The main combustion chamber inlet 78 is connected to and communicates with the air passageway 68 so that the flow of air 48 flowing through the motor housing 40 flows through the air passageway 68 and into the combustion chamber 34 through the main combustion chamber inlet 76. The secondary combustion chamber inlet 78 is open to and communicates with the vestibule chamber interior 66. Because the combustion chamber 34 has a plurality of inlets that communicate with both the motor housing 40 and the vestibule chamber interior 66, a first portion 80 of the flow of air 28 being drawn into the furnace 20 by the fan 30 will flow from the vestibule chamber interior 66 and into the motor housing 40 and through the air passageway 68 and then enter the combustion chamber 34 through the main combustion chamber inlet 76. A second portion 82 of the flow of air 28 being drawn into the furnace 20 by the fan 30 will flow from the vestibule chamber interior 66 directly into the combustion chamber 34 through the secondary combustion chamber inlet 78. The first and second portions 80, 82 join together in the combustion chamber 34 and are drawn through the rest of the furnace 20 as described above. Because the flow of air 24 being drawn into the furnace 20 by the fan 30 will follow the path of least resistance, the resistance encountered by the first and second portions 80, 82 of the flow of air 28 must be designed and balanced so that a sufficient amount of air flows through the motor housing 40 to cool the motor 32. The resistance to the first portion 80 of the air flow 28 is determined generally by the number, size, location and spacing of the plurality of motor housing inlets 70 and the spacing and restrictions experienced between the motor housing 40 and the motor 32 and any obstructions encountered within the air passageway 68 prior to flowing the combustion chamber 34. The resistance encountered by the second portion 82 of the air flow 28 is generally determined by the size, dimension and location of the secondary combustion chamber inlet 78. While the secondary combustion chamber inlet 78 has been shown as being a single inlet, it should be understood that the secondary combustion chamber inlet 78 can be one of a plurality of secondary combustion chamber inlets without departing from the scope of the invention as defined by the claims.

Figure 2A:
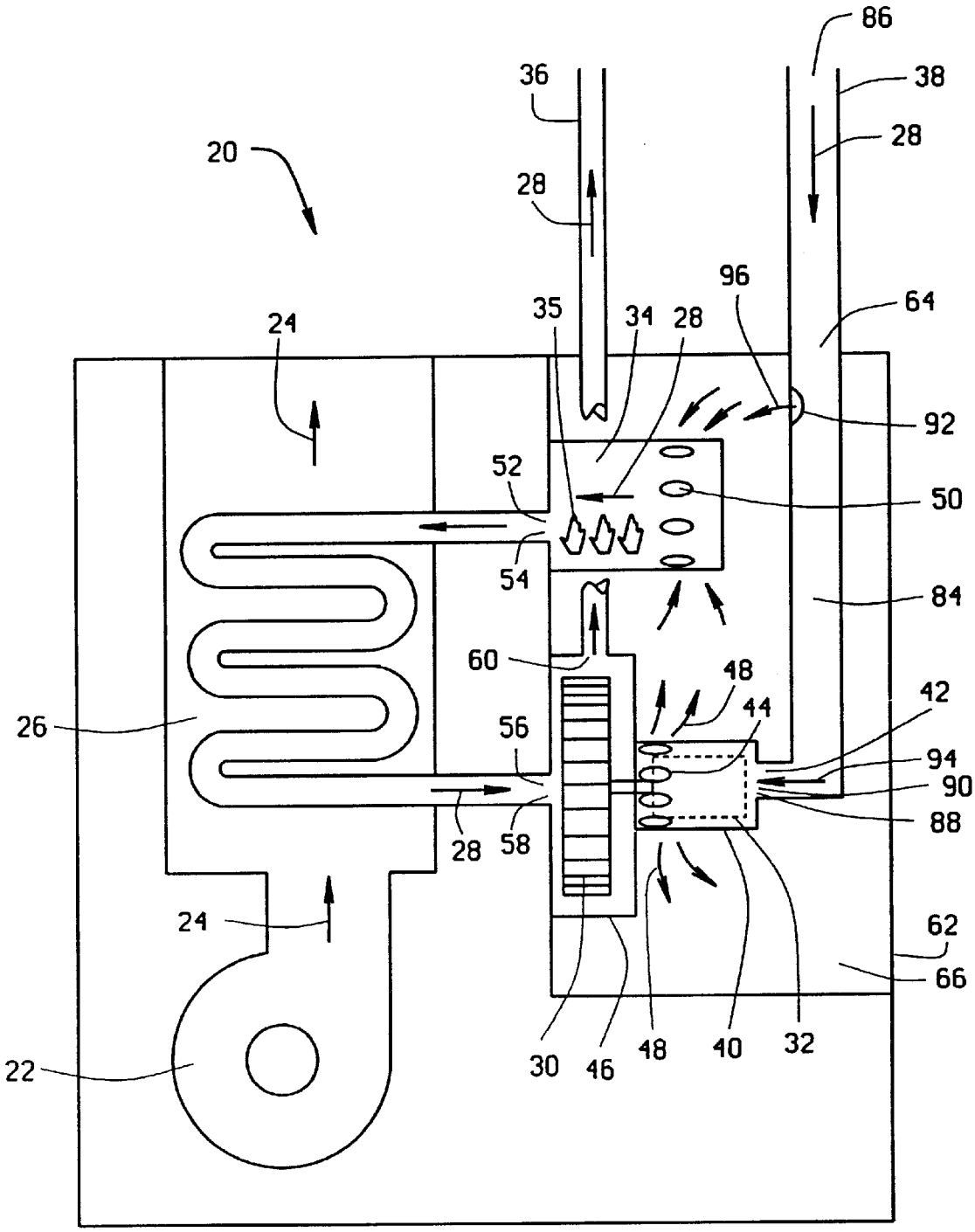
FIG. 2A is a perspective view of a traditional furnace employing an alternative embodiment of the present invention to cool the motor that drives the fan.

In an alternate embodiment, as shown in FIGS. 2A and B, the at least one vestibule chamber inlet 64 is connected to and communicates with the at least one motor housing inlet 42 by an air passageway 84 having at least one inlet 86 and at least one outlet 88. The air passageway 84 causes the flow of air 48 through the motor housing 40 to originate outside of the vestibule chamber 62 and flow through the at least one vestibule chamber inlet 64 and the at least one air passageway inlet 86 prior to entering the motor housing 40. The at least one air passageway outlet 88 is connected to the at least one motor housing inlet 42 and the flow of air 48 flowing through the motor housing 40 flows from the air passageway 84 through the at least one air passageway outlet 88 and into the motor housing 40 through the at least one motor housing inlet 42. The flow of air 48 then exits the motor housing 40 through the at least one motor housing outlet 44 and flows into the vestibule chamber interior 66. The vestibule chamber interior 66 is operatively connected to and communicates with the at least one combustion chamber inlet 50 so that the flow of air 48 exiting the motor housing 40 and entering the vestibule chamber interior 66 flows through the vestibule chamber interior 66 and then into the combustion chamber 34 through the at least one combustion chamber inlet 50. Preferably, the vestibule chamber 62 is sealed so that the entire flow of air 28 being drawn into the furnace 20 by the fan 30 flows through the at least one vestibule chamber inlet 64 and through the air passageway 84. Because the vestibule chamber 62 is sealed, all air flowing through the vestibule chamber interior 66 flows into the combustion chamber 34 through the at least one combustion chamber inlet 50.

In one aspect of the alternate embodiment, as can be seen in FIG. 2A, the at least one air passageway outlet 88 is one of a plurality of air passageway outlets. The air passageway 84 has a primary air passageway outlet 90 and at least one secondary air passageway outlet 92. The primary air passageway outlet 90 is connected to the at least one motor housing inlet 42 and the at least one secondary air passageway outlet 92 is open to the vestibule chamber interior 66. Because the air passageway 84 has a plurality of outlets, the flow of air 28 being drawn into the furnace 20 by the fan 30 will be split into a plurality of flows of air. A first portion 94 of the flow of air 28 will be channeled through the air passageway 84 and into the motor housing 40 through the primary air passageway outlet 90. The first portion 94 of the flow of air 28 is the same as the flow of air 48 flowing through the motor housing 40. The first portion 94 of the flow of air 28 exits the motor housing 40 through the at least one motor housing outlet 44 and flows into the vestibule chamber interior 66. A second portion 96 of the flow of air 28 will be channeled through the air passageway 84 and into the vestibule chamber interior 66 through the at least one secondary air passageway outlet 92. Because the vestibule chamber 62 is sealed, the first and second portions 94, 96 of the flow of air 28 can mix together in the vestibule chamber interior 66 and are both drawn into the combustion chamber 34 through the at least one combustion chamber inlet 50. The first and second portions 94,96 then flow through the heat exchanger 42 and the fan housing 46 and are exhausted from the furnace 20 through the exhaust pipe 36.

When the air passageway 84 has both a primary air outlet 90 and at least one secondary air passage outlet 92, the flow of air 28 being drawn into the furnace 20 by the fan 30 will follow the path of least resistance when being drawn into the combustion chamber 34. Therefore, the resistance experienced by the first portion 94 of the flow of air 28 and the second portion 96 of the flow of air 28 must be designed and balanced to ensure that the first portion 94 of the flow of air 28 which flows through the motor housing 40 is adequate to cool the motor 32. As was discussed above, the general factors that effect the resistance experienced by the first and second portions 94, 96 of the flow of air 28 include the size, location and obstructions experienced by both the first and second portions 94, 96 of the flow of air 28 as they follow their respective flow paths.

Figure 2B:
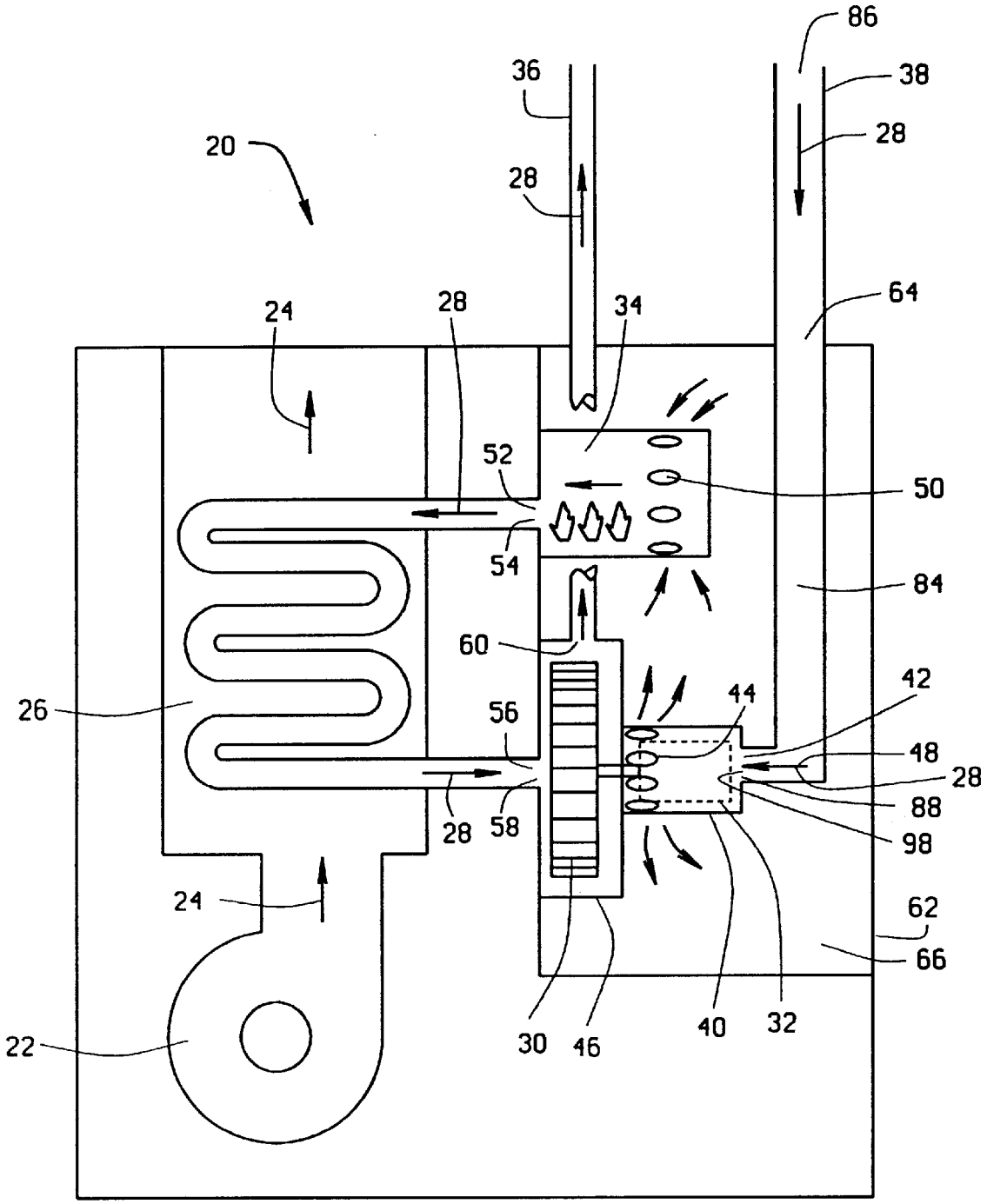
FIG. 2B is a perspective view of the furnace of FIG. 2A wherein the air passageway has a single outlet.

In another aspect of the alternate embodiment, as can be seen in FIG. 2B, the at least one air passageway outlet 88 is a single air passageway outlet 98 and is connected to the at least one motor housing inlet 42. The air passageway 84 channels the flow of air 28 being drawn into the furnace 20 by the fan 30 through the single air passageway outlet 98 and into the motor housing 40 through the at least one motor housing inlet 42. The entire flow of air 28 through the furnace flows through the motor housing 40. A maximum amount of air flows through the motor housing 40 to cool the motor 32 and a maximum amount of cooling occurs.

Figure 3:
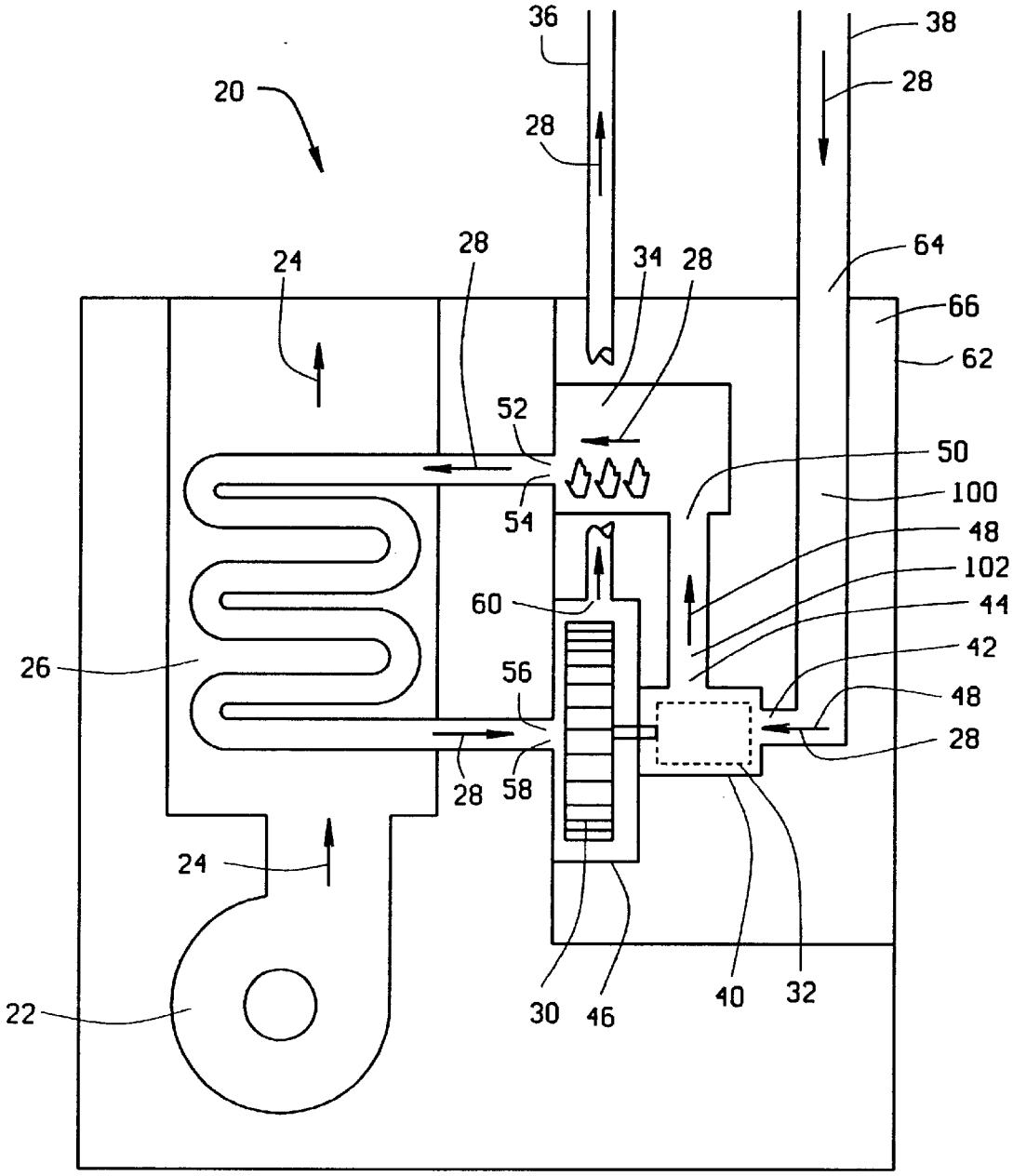
FIG. 3 is a perspective view of another embodiment of the furnace.

In yet another alternate embodiment, as can be seen in FIG. 3, the at least one vestibule chamber inlet 64 is connected to the at least one motor housing inlet 42 by a first air passageway 100. The first air passageway 100 causes the flow of air 28 being drawn into the furnace 20 by the fan 30 to originate outside of the vestibule chamber 62 and flow through the at least one vestibule chamber inlet 64, through the first air passageway 100, and into the motor housing 40 through the at least one motor housing inlet 42. The at least one motor housing outlet 44 is connected to the at least one combustion chamber inlet 50 by a second air passageway 102. The second air passageway 102 causes the flow of air 28 to flow from the motor housing 40, through the at least one motor housing outlet 44, through the second air passageway 102 and into the combustion chamber 34 through the at least one combustion chamber inlet 50. The flow of air 28 then flows through the heat exchanger 28, through the fan housing 46 and exits the furnace 20 through the exhaust pipe 36.

While the present invention has been described by reference to specific embodiments, it should be understood that modifications and variations of the invention may be constructed without departing from the scope of the invention as defined by the following claims.

What is claimed is:

1. A furnace comprising:

a motor in a motor housing, the motor housing having at least one motor housing inlet and at least one motor housing outlet;

a fan driven by the motor and residing in a fan housing, the fan housing being operatively connected to and communicating with the at least one motor housing outlet and configured and adapted to cause a flow of air to flow through the motor housing prior to entering the fan housing to thereby cool the motor;

a combustion chamber configured and adapted to alter the temperature of air passed therethrough, the combustion chamber being operatively connected between and communicating with the at least one motor housing outlet and the fan housing and configured and adapted to cause the flow of air to flow through the combustion chamber after exiting the at least one motor housing outlet and before entering the fan housing; and the furnace is a high efficiency furnace.

2. A furnace comprising:

a motor in a motor housing, the motor housing having at least one motor housing inlet and at least one motor housing outlet; and a fan driven by the motor and residing in a fan housing, the fan housing being operatively connected to and communicating with the at least one motor housing outlet and configured and adapted to cause a flow of air to flow through the motor housing prior to entering the fan housing to thereby cool the motor;

the fan housing has a single fan housing inlet and a single fan housing outlet, the single fan housing inlet being operatively connected to and communicating with the at least one motor housing outlet and the flow of air enters the fan housing through the single fan housing inlet.

3. A furnace comprising:

a motor in a motor housing, the motor housing having at least one motor housing inlet and at least one motor housing outlet;

a combustion chamber having at least one combustion chamber inlet and a combustion chamber outlet, the at least one combustion chamber inlet being operatively connected to and communicating with the at least one motor housing outlet;

a heat exchanger having a heat exchanger inlet and a heat exchanger outlet, the heat exchanger inlet being operatively connected to and communicating with the combustion chamber outlet; and a fan driven by the motor and residing in a fan housing, the fan housing having a fan housing inlet and a fan housing outlet, the fan housing inlet being operatively connected to and communicating with the heat exchanger outlet, the fan causing a flow of air to flow into the motor housing through the at least one motor housing inlet around the motor and exit the motor housing through the at least one motor housing outlet and flow into the combustion chamber through the at least one combustion chamber inlet and exit the combustion chamber through the combustion chamber outlet and flow into the heat exchanger through the heat exchanger inlet and exit the heat exchanger through the heat exchanger outlet and flow into the fan housing through the fan housing inlet and exit the fan housing through the fan housing outlet, the flow of air thereby cooling the motor as it flows through the motor housing.

4. The furnace of claim 3, further comprising:

a vestibule chamber having at least one vestibule chamber inlet, the motor and the motor housing residing in an interior of the vestibule chamber, and the flow of air flows through the at least one vestibule chamber inlet prior to flowing into the combustion chamber.

5. The furnace of claim 4, wherein:

the at least one motor housing outlet is operatively connected to and communicates with the at least one combustion chamber inlet by an air passageway, the air passageway channeling the flow of air from the at least one motor housing outlet to the at least one combustion chamber inlet.

6. The furnace of claim 5, wherein:

the at least one motor housing inlet is one of a plurality of motor housing inlets and the at least one vestibule chamber inlet is one of a plurality of vestibule chamber inlets.

7. The furnace of claim 5, wherein:

the combustion chamber is sealed and configured and adapted so that the only air flowing through the combustion chamber flows through the air passageway.

8. The furnace of claim 7, wherein:

all of the air flow entering the motor housing through the at least one motor housing inlet flows through the vestibule chamber inlet without circulating in the vestibule chamber before entering the motor housing.

9. The furnace of claim 5, wherein:

the at least one combustion chamber inlet is one of a plurality of combustion chamber inlets and the air passageway is connected to at least one of the plurality of combustion chamber inlets.

10. The furnace of claim 5, wherein:

the furnace is a high efficiency furnace.

11. The furnace of claim 5, wherein:

all of the air flow entering the combustion chamber through the at least one combustion chamber inlet flows through the motor housing before entering the combustion chamber.

12. The furnace of claim 4, wherein:

the at least one vestibule chamber inlet is operatively connected to and communicates with the at least one motor housing inlet by an air passageway having at least one air passageway inlet and at least one air passageway outlet, the air passageway being configured and adapted to cause the flow of air to originate outside of the vestibule chamber and flow through the at least one vestibule chamber inlet and the at least one air passageway inlet, the at least one air passageway outlet being operatively connected to and communicating with the at least one motor housing inlet so that the flow of air is channeled by the air passageway into the motor housing through the at least one motor housing inlet, the flow of air then exiting the motor housing through the at least one motor housing outlet and flowing into the interior of the vestibule chamber, the interior of the vestibule chamber being operatively connected to and communicating with the at least one combustion chamber inlet so that the flow of air flowing out of the motor housing into the interior of the vestibule chamber flows into the combustion chamber through the at least one combustion chamber inlet.

13. The furnace of claim 12, wherein:

the vestibule chamber is sealed except for the at least one vestibule chamber inlet so that only air flowing into the vestibule chamber interior through the vestibule chamber inlet flows into the combustion chamber through the at least one combustion chamber inlet.

14. The furnace of claim 13, wherein:

the furnace is a high efficiency furnace.

15. The furnace of claim 13, wherein:

the at least one air passageway outlet is one of a plurality of air passageway outlets comprised of a primary air passageway outlet and at least one secondary air passageway outlet, the primary air passageway outlet being operatively connected to and communicating with the at least one motor housing inlet and the at least one secondary air passageway outlet communicating with the interior of the vestibule chamber, the primary air passageway outlet channeling the flow of air into the motor housing and the at least one secondary air passageway outlet channeling air into the interior of the vestibule chamber.

16. The furnace of claim 13, wherein:

the at least one air passageway outlet is a single air passageway outlet and is operatively connected to and communicates with the at least one motor housing inlet, the air passageway channeling the flow of air through the single air passageway outlet and into the motor housing.

17. The furnace of claim 13, wherein:

all of the air flow entering the combustion chamber through the at least one combustion chamber inlet flows through the motor housing before entering the combustion chamber.

18. The furnace of claim 17, wherein:

all of the air flow entering the combustion chamber through the at least one combustion chamber inlet circulates in the vestibule chamber before entering the combustion chamber.

19. The furnace of claim 4, wherein:

the at least one vestibule chamber inlet is operatively connected to and communicates with the at least one motor housing inlet by a first air passageway, the first air passageway being configured and adapted to cause the flow of air to originate outside of the vestibule chamber and flow through the at least one vestibule chamber inlet and into the motor housing through the at least one motor housing inlet; and the at least one motor housing outlet is operatively connected to and communicates with the at least one combustion chamber inlet by a second air passageway, the second air passageway being configured and adapted to cause the flow of air to flow from the motor housing through the at least one motor housing outlet and into the combustion chamber through the at least one combustion chamber inlet.

20. A method of air cooling a furnace blower motor comprising the steps of:

providing a motor in a housing;

providing a fan driven by the motor and positioning the fan in a fan housing;

operatively connecting the fan housing to the motor housing so that the fan housing communicates with the motor housing and draws a flow of air through the motor housing to cool the motor; and providing a fan housing having a single fan housing inlet and a single fan housing outlet and operatively connecting the single fan housing inlet to the motor housing to cause the flow of air to flow through the motor housing prior to flowing into the fan housing through the single fan housing inlet.

21. A method of air cooling a furnace blower motor comprising the steps of:

providing a motor in a housing;

providing a fan driven by the motor and positioning the fan in a fan housing;

operatively connecting the fan housing to the motor housing so that the fan housing communicates with the motor housing and draws a flow of air through the motor housing to cool the motor;

providing the fan housing having a single fan housing inlet and a single fan housing outlet and operatively connecting the single fan housing inlet to the motor housing to cause the flow of air to flow through the motor housing prior to flowing into the fan housing through the single fan housing inlet;

providing a combustion chamber that is operatively connected between and communicates with the motor housing and the fan housing and is configured and adapted to cause the flow of air to flow from the motor housing and through the combustion chamber prior to flowing to the fan housing;

providing a heat exchanger that is operatively connected between and communicates with the combustion chamber and the fan housing and is configured and adapted to cause the flow of air to flow from the combustion chamber and through the heat exchanger prior to flowing into the fan housing; and providing a vestibule chamber having an interior and at least one vestibule chamber inlet which is operatively connected to and communicates with the motor housing, the motor and the motor housing residing in the vestibule chamber interior so that the flow of air flowing through the motor housing passes through the at least one vestibule chamber inlet prior to entering the motor housing.

22. The method of claim 21, wherein:

the vestibule chamber is sealed except for the vestibule chamber inlet;

the vestibule chamber interior is operatively connected to and communicates with the combustion chamber and the motor housing so that the flow of air flowing through the motor housing exits the motor housing and flows through the vestibule chamber interior and into the combustion chamber; and the motor housing is operatively connected to and communicates with the at least one vestibule chamber inlet by an air passageway that causes the flow of air to originate outside of the vestibule chamber and flow through the at least one vestibule chamber inlet, the air passageway channeling the flow of air to the motor housing without mixing with the air flowing through the vestibule chamber interior prior to flowing through the motor housing.

23. The method of claim 21, wherein:

air flowing through the vestibule chamber interior enters the vestibule chamber interior through the at least one vestibule chamber inlet;

the motor housing is operatively connected to and communicates with the combustion chamber by an air passageway that channels the flow of air from the motor housing directly to the combustion chamber and prevents the flow of air flowing through the air passageway from mixing with the air flowing through the vestibule chamber interior; and the flow of air flowing through the motor housing flows through the vestibule chamber interior prior to entering the motor housing.

* * * * *